US005351429A

United States Patent [19]

Ford

[11] Patent Number: 5,351,429

[45] Date of Patent: Oct. 4, 1994

[54] LASER SIGHTING DEVICE FOR FIREARMS

[76] Inventor: Wilson H. Ford, 26182 Buena Vista Dr., Laguna Hills, Calif. 92653

[21] Appl. No.: 23,947

[22] Filed: Feb. 26, 1993

[51] Int. Cl.[5] ..... F41G 1/36

[52] U.S. Cl. ..... 42/103; 362/110

[58] Field of Search ..... 33/241; 42/1.01, 103; 362/110, 111, 112, 113, 114

[56] References Cited

U.S. PATENT DOCUMENTS

| | | | |
|---|---|---|---|
| 664,074 | 12/1900 | Benjamin | 362/114 |
| 4,777,754 | 10/1988 | Reynolds | 42/103 |
| 5,033,219 | 7/1991 | Johnson et al. | 42/103 |

FOREIGN PATENT DOCUMENTS

| | | | |
|---|---|---|---|
| 2602037 | 1/1988 | France | 33/241 |

OTHER PUBLICATIONS

Shooting Times, "Lights . . . Taurus . . . Action", Mar. 1990.

*Primary Examiner*—Stephen G. Bentley
*Attorney, Agent, or Firm*—John E. Vanderburg

[57] ABSTRACT

An aiming device includes a laser housing attached to the trigger guard and adapted to fit snugly on the receiver assembly of a gas operated, slide actuated automatic weapon. The laser housing is provided with two vertically aligned parallel running compartments. The upper compartment contains the laser emission module while the lower compartment contains the power supply. The rear of each compartment is provided with a passage which opens to a slot in the rear of the housing to provide access for the electrical connection of the power supply, the laser emitter and an actuator switch which is carried in the slot. In this manner all electrical components for operating the aiming device are contained within the laser housing.

The laser emission module consists of a laser diode and associated laser driver circuitry in a container configured to be received in the upper compartment of the laser housing. The emission end of the container is provided with one or more lenses for focusing the laser beam. The laser module has smaller outside diameter than the inside diameter of the upper compartment to provide room to move the module to adjust the windage and the elevation of the laser emission.

6 Claims, 3 Drawing Sheets

LASER SIGHTING DEVICE FOR FIREARMS

FIELD OF THE INVENTION

The invention relates to firearms and more particularly to a laser operated aiming device for firearms.

BACKGROUND OF THE INVENTION

Various devices to assist in the aiming of firearms are well known in the art. Such devices include the use of light beams to indicate when the weapon is correctly aimed at a target. Reference may be had to U.S. Pat. Nos. 689,547, 894,306, 1,149,705, 1,452,651, 1,826,004, 1,993,979, 2,017,585, 2,884,710, and 2,912,566. These patents propose clamping a light source with lens, reflector, power source anti an on/off switch to a handgun. Similarly U.S. Pat. Nos. 3,010,019 and 3,974,585, French Pat. No. 1,015,421, British Pat. No. 5029, Swiss Pat. Nos. 29,708 and 66,753 and German Patent Publication 1,926,337 propose incandescent lamps for providing aiming points on a target or optical sight.

With the development of gas discharge lasers comparable in size, ruggedness and power requirements to an incandescent lamp, such devices have been proposed for use as a marksmanship trainer, weapon simulator, bore sighting device for firearms and similar applications such as proposed in U.S. Pat. Nos. 3,633,285, 3,782,832, 3,898,747, 3,938,262 and 3,995,376. Laser assisted aiming devices have been proposed in U.S. Pat. Nos. 4,079,534, 4,152,754, 4,161,076, 4,168,588 and 4,212,109.

While these devices have been effective for their purpose they are subject to certain deficiencies which have generally limited their use to special areas, such as competitive marksmanship and the like. Many of the devices are bulky or have exposed wires so that when attached to a hand weapon, the aiming device prevents the weapon from being carried in a holster.

SUMMARY OF THE INVENTION

The disadvantages of the devices of the prior art are overcome by the aiming device of the invention which has no exposed circuitry and less bulk so that a handgun to which the device is affixed can be carried in a holster designed for that weapon. The windage and elevation adjustment means has been improved to make bore-sighting adjustments relatively easy and permanent although it is highly recommended practice to periodically check the aiming device to insure that it is securely mounted on the weapon and to bore sight the weapon as required. The device can be operated right or left handed and can be activated without the necessity of changing the users grip on the weapon and without requiring additional training or changes in the training procedures. The device is readily installed on hand weapons and rifles without special tools or gunsmithing.

In one aspect of the invention, the device comprises a laser housing attached to the trigger guard and adapted to fit snugly on the receiver assembly of a gas operated, slide actuated automatic weapon. The laser housing is provided with two vertically aligned parallel running compartments. The upper compartment contains the laser emission module while the lower compartment contains the power supply. The rear of each compartment is provided with a passage which opens to a slot in the rear of the housing to provide access for the electrical connection of the power supply, the laser emitter and an actuator switch which is carried in the slot. In this manner all electrical components for operating the aiming device are contained within the laser housing.

The laser emission module consists of a laser diode and associated laser driver circuitry in a container configured to be received in the upper compartment of the laser housing. The emission end of the container is provided with one or more lenses for focusing the laser beam. The laser module has a smaller outside diameter than the inside diameter of the upper compartment to provide room to move the module to adjust the windage and the elevation of the laser emission.

In a preferred embodiment of the invention, an off-axis counter bore is provided in the rear of the upper compartment. The counterbore receives a spring and the rear end of the laser module so that the module is spring loaded in the compartment and is biased downwardly and to the right in the emission direction. A first threaded passage extends from a side surface of the laser housing and opens into the upper compartment adjacent the upper surface of the laser module and a second threaded passage extends from the opposite side surface and opens into the upper compartment adjacent a side of the laser module. A screw having the inner end configured to correspond to the shape of the container of the laser module is set in each passage. The shaped inner ends of the screws act as cams against the surface of the laser module to adjust the module for elevation and traverse. This adjustment is opposed by the spring which serves to maintain the module against the screw cams to retain the elevation and windage setting of the aiming device.

The lower compartment contains the power supply which is an "A" size battery. Power output is conducted by wires which extend through the passage in the rear of the compartment to communicate with the driver circuitry of the laser module in the upper compartment.

Preferably the activation switches are of the tap on/-tap off type of conventional design. These switches are highly preferred for their ease of operation which allows a shooter to activate the aiming device by a simple inward pressure of the trigger finger.

The driver circuitry allows for the deactivation of the aiming device by simply re-pressing the activation switch. In addition the driver circuitry includes an automatic shut-off of the laser in the event it is accidently activated.

In one embodiment, the laser housing is secured to the trigger guard of the automatic hand weapon by a pair of mounting plates which are attached to the laser housing and extend rearwardly therefrom towards the trigger guard of the weapon. The extending edges of the mounting plates are inwardly turned and configured to clamp on the trigger guard. The laser housing is urged under the slide on the receiver assembly by means in a passage in the lower portion of the laser housing which opens on the rear face of the housing adjacent to the trigger guard. A screw actuated member seated in the passage acts against the trigger guard to secure the laser housing onto the receiver assembly under the slide responsive to turning of the screw.

In yet another embodiment of the invention, the laser housing is adapted for the attachment of a flashlight on the housing. In this embodiment a pair of opposed downwardly extending spring arms are formed on the laser housing. These arms define a snap-on mount for the flashlight.

Further advantages and features of the present invention will become apparent from the following description of the preferred embodiment of the invention taken in conjunction with the drawings.

DETAILED DESCRIPTION OF THE INVENTION

Figure 1:
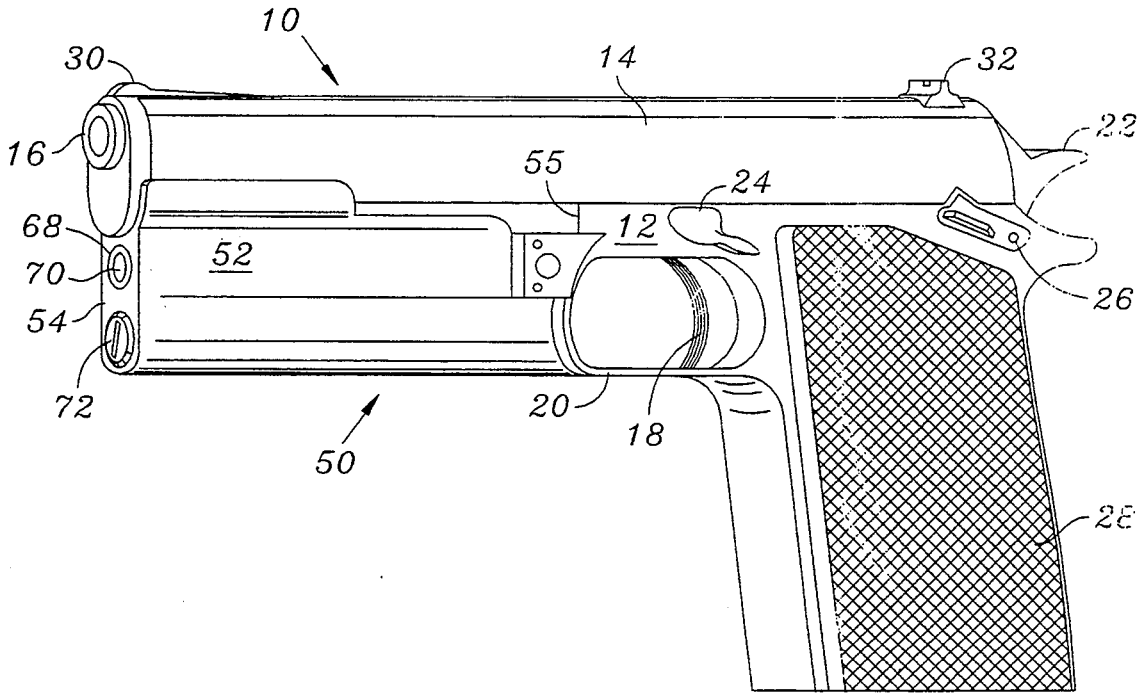
FIG. 1 is a perspective view of a firearm with an aiming device according to the present invention.

Referring to FIG. 1 there is illustrated a slide actuated automatic handgun 10 comprising a receiver group 12, a slide 14 reciprocally mounted on the receiver group and a barrel 16 disposed in the slide and relatively stationary with respect to the slide. The receiver group 12 also includes a trigger 18, trigger guard 20 and a hammer 22 which is mechanically connected to the trigger and released when the trigger is pulled. A safety latch 24 and a safety latch 26 are provided to lock the slide 14 in its rearward position or in its forward position respectively. The receiver group 12 also carries a grip 28 for handling the weapon 10. The grip defines an interior (not shown) which communicates through the grip 28 to the chamber (not shown) at the rear of the barrel and to the exterior of the grip for insertion of a clip containing a number of rounds. The clip is spring loaded for urging the rounds upward where they are stripped individually by the forward movement of the slide 14 and loaded into the chamber. Upon firing the weapon the gas produced acts against a piston in the receiver group 12 which forces the slide 14 rearwardly. An ejector on the slide strips the casing of the expended round from the chamber and the weapon is set to repeat the sequence of events. A front sight 30 and rear sight 32 extend upwardly from the top of the slide 14 and the weapon is properly aimed when a target, the front sight and the rear sight are aligned.

Figure 3:
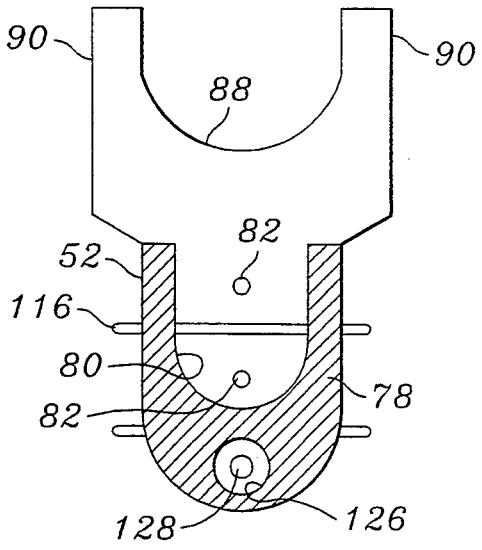
FIG. 3 is a rear view of the aiming device of FIG. 1 with trigger guard mounting plates removed.
Figure 2:
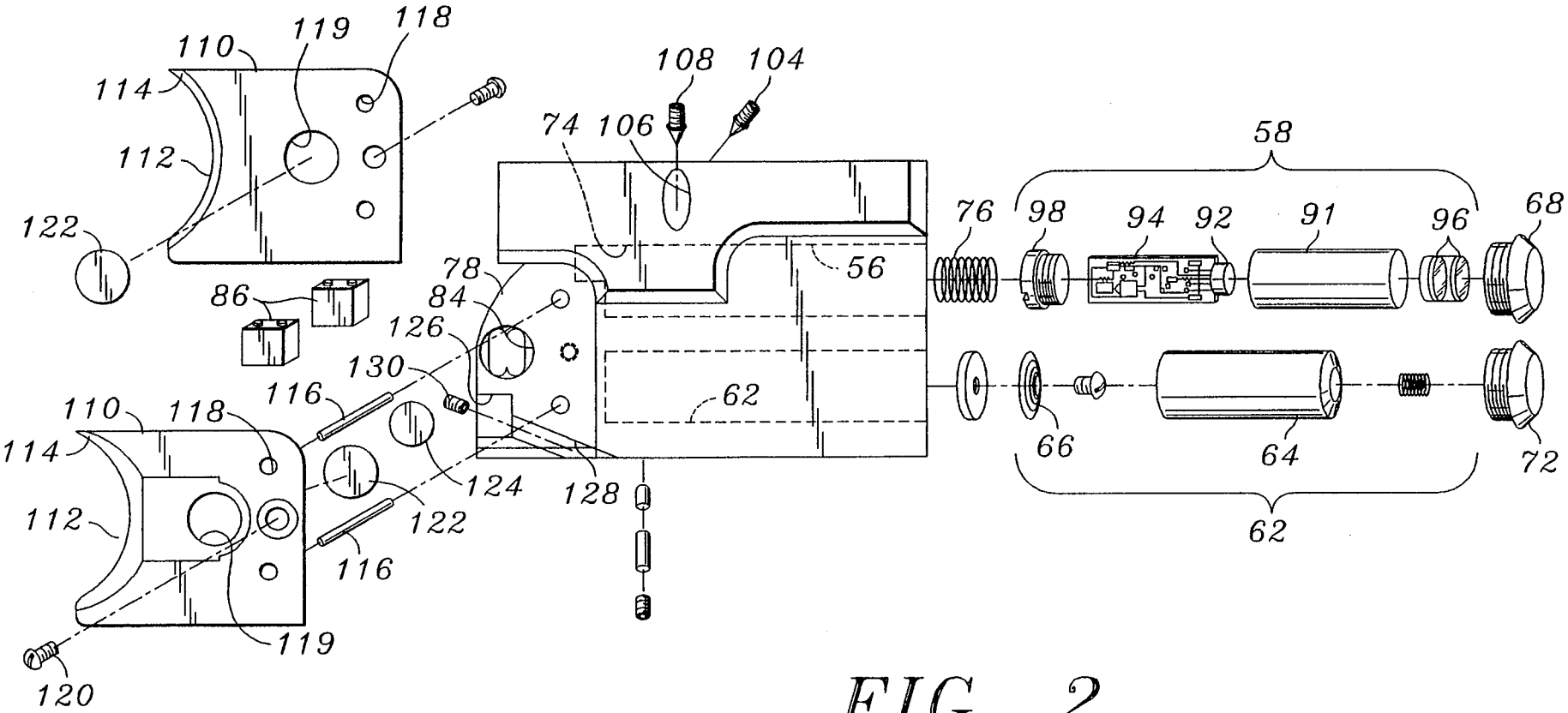
FIG. 2 is an exploded view of the aiming device shown in FIG. 1.
Figure 5:
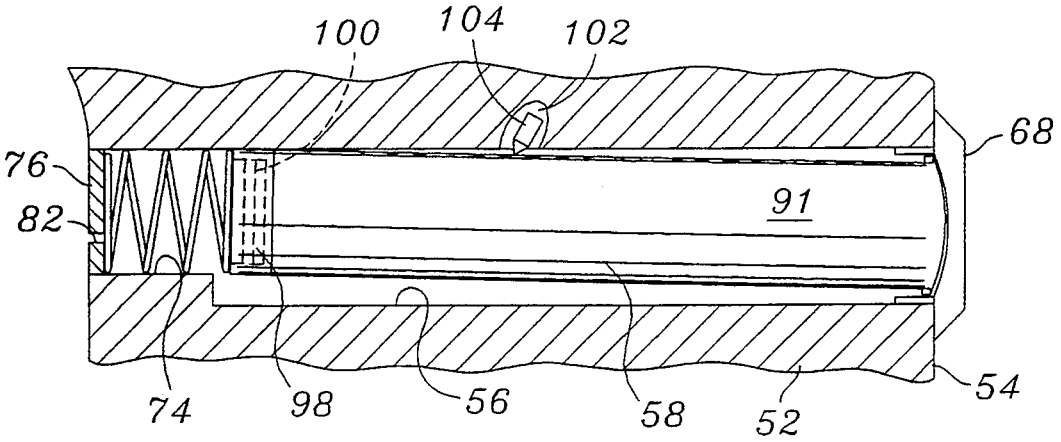
FIG. 5 is a side sectional view of the device of FIG. 1.
Figure 6:
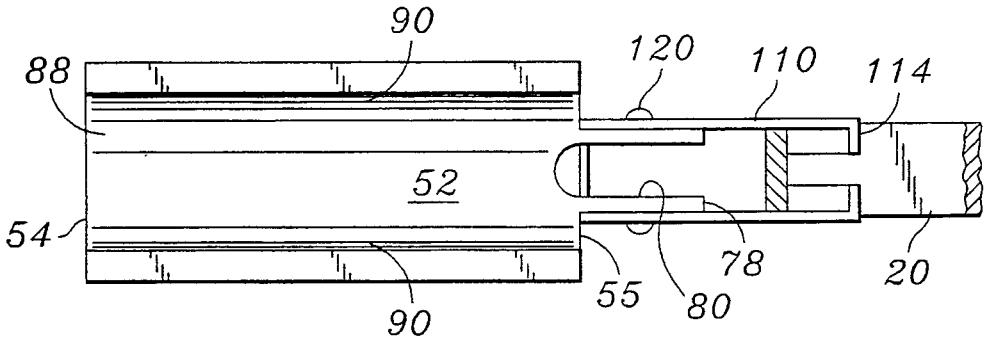
FIG. 6 is a top plan view of the device of FIG. 1.

The aiming device 50 of the invention consists of a laser housing 52 having an emission end 54 through which a laser beam is emitted towards the target and an opposite mounting end 55. The laser housing 52 is carried by the receiver group 12 beneath the slide 14 forward of the trigger 18 so as to not interfere with the trigger or with the slide. As is more clearly shown in FIG. 2, the laser housing 52 includes an upper laser compartment 56 open at the emission end 54 which receives a laser module 58 and a lower battery compartment 62, also open at the emission end, which receives the battery 64 and the electrical conductor 66. The laser compartment 56 is closed at the emission end 54 by a threaded cap 68 having a port 70 for the laser emission. The battery compartment 62 is also closed at the emission end 54 by a threaded cap 72. The back wall of the laser compartment 56 defines a off-axis mounting seat 74 for a spring member 76 which is utilized in boresighting the laser module 58 as shown in FIG. 5 and which will be explained in more detail below. The rear face 78 at the mounting end 55 of the laser housing 52 is adjacent the trigger guard 20 when the aiming device is assembled on the weapon 10. As is most clearly shown in FIGS. 3 and 6, a slot 80 in the rear face 78 opens to the rear face and terminates adjacent the rear wall of the compartments 56 and 62. An opening 82 communicates between the compartments 56 and 62 and the slot 80 for the passage of electrical conductors therethrough. An opening 84 in each side wall of the laser housing 52 receives an on/off switch 86 for activating the aiming device 50 from either side of the weapon 10. All of the electrical wiring connecting the switches 86, the battery 64 and the laser module 58 are contained in the slot 80 and is not exposed when the device 50 is mounted on the weapon 10. The top face 88 of the laser housing 52 is contoured to the shape of the undersurface of the receiver group 12 and the edges are extended upward at 90 to define a channel for receiving the lower portion of the receiver group.

The laser module 58 (FIGS. 2 and 5) consists of an open ended container 91 in which is disposed a laser diode 92 electrically connected to a circuit board 94 which carries the laser driver and control circuitry. The laser diode 92 is preferably an index guided diode although good results are achieved using a gain guided diode. Both types of diodes, as well as the particular driver circuitry for each, are known in the art and do not per se form a part of the present invention. A pair of lenses 96 are carried in the container 91 in the emission path of the laser diode 92 to focus the laser emission. The container 91 is sealed at the emission end by the cap 68 and at its opposite end by a spring retainer cap 98.

Figure 4:
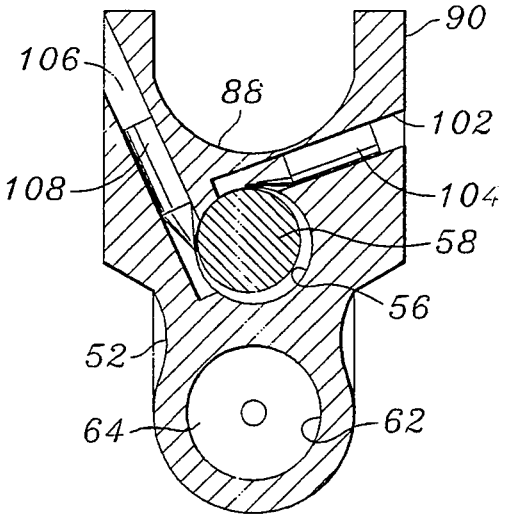
FIG. 4 is a front sectional view of the device of FIG. 1.

As most clearly shown by FIGS. 4 and 5, the laser module 58 is spring loaded in the laser compartment 56 by the spring 76 which is received in the mounting seat 74 formed in the rear wall of the laser compartment. The outer surface of the spring retainer cap 98 is also counterbored to define a seat 100 for the opposite end of the spring 76. As described, the mounting seat 74 is disposed off-axis with respect to the axis of the laser compartment 56 so that the spring 76 biases the end of the laser module 58 upwardly and to the to the left of the axis of the laser compartment. The emission end of the laser module 58 is convex and the inner surface of the emission cap 68 is correspondingly concave to form a ball socket about which the laser module can pivot.

A first threaded passage 102 opening on the side surface of tile laser housing 52 is biased inwardly downwardly to intersect the laser compartment 56 and a screw 104 having a cortically shaped inner end is disposed in the passage for contact between its inner end and the upper surface of the laser module 58. The first passage is biased downwardly at a slight angle of between about 15° and about 20°. Turning the screw 104 clockwise causes its cortically shaped inner end to move inwardly in the passage 102 and to cam against the upper surface of the laser module 58 forcing it to pivot downward in the laser compartment 56 to raise the strike of the laser beam. Turning the screw 104 counterclockwise decreases the camming pressure on the upper surface of the laser module 58 allowing it to pivot upwardly due to the urging of the spring 76 thus lowering the strike of the laser beam. A second passage 106 in the opposite side of tile laser housing 52 is biased downwardly inwardly at an angle of between about 25° and about 30° and a second screw 108 of the same configuration as the screw 104 is threadably disposed therein. The second screw 108 urges the laser module 58 to pivot in a generally horizontal plane to move the strike of the laser beam to the right. Turning the screw 108 counterclockwise moves the screw outwardly and relieves the pressure on the side of the laser module and laser module pivots back to the left due to the urging of the spring 76. Thus it will be seen that adjustment of the first screw 104 adjusts the elevation and adjustment of the second screw 108 adjust windage for boresighting the aiming device 50 and the weapon 10.

The aiming device 50 is secured to the trigger guard 20 by a pair of mounting plates 110 which are configured at one end 112 to the shape of the trigger guard. The configured ends 112 of the mounting plates 110 are oppositely inwardly turned to define stops 114 which lock the laser housing 52 against the forward portion of the trigger guard 20 as is most clearly shown in FIG. 6. Guide pins 116 extend through alignment holes 118 in the mounting plates 110 as an aid in securing the mounting plates properly on the laser housing 52. An access opening 119 in the mounting plates 110 is aligned with the opening 84 to provide access to the switches 86. Preferably, a switch button cap 122 is disposed over the switch 86 and is retained by the mounting plate 110. The mounting plates 110 are secured to the laser housing 52 by screws 120. A ball bearing 124 is seated in a bearing seat 126 and a threaded passage 128 communicates between the bearing seat and lower surface of the laser housing 52. A screw 130 in the passage acts against the bearing 124 to draw the stops 114 against the trigger guard 20 and to tighten the laser housing 52 on the receiver group 12 of the weapon 10.

The aiming device 50 is mounted on the weapon 10 by first removing the mounting plates 110 from the laser housing 52. The switch button caps 122 are also removed at this point. The screw 130 is backed out in the passage 128 to insure that the ball bearing 124 will fully retract in the bearing seat 126. The laser housing 52 is pushed up under the receiver group 12 and rearward to the trigger guard 20 as far as it will travel. One switch button cap 122 is inserted through the opening 84 in the mounting plate 110 from the inner face of the plate. The mounting plate 110 is then placed on the laser housing with the guide pins 116 in the alignment holes 118 of the mounting plate. The mounting plate 110 is then secured to the laser housing by a screw 120. This process is repeated with the opposite side mounting plate 110. The screw 130 is turned down in the threaded passage 128 against the ball bearing 124 forcing the bearing outward in its seat 126 against the trigger guard 20. This forces the top face 88 of the laser housing tightly against the undersurface of the receiver and pulls the stops 114 against the trigger guard 20 to rigidly secure the aiming device 50 on the weapon 10.

Figure 7:
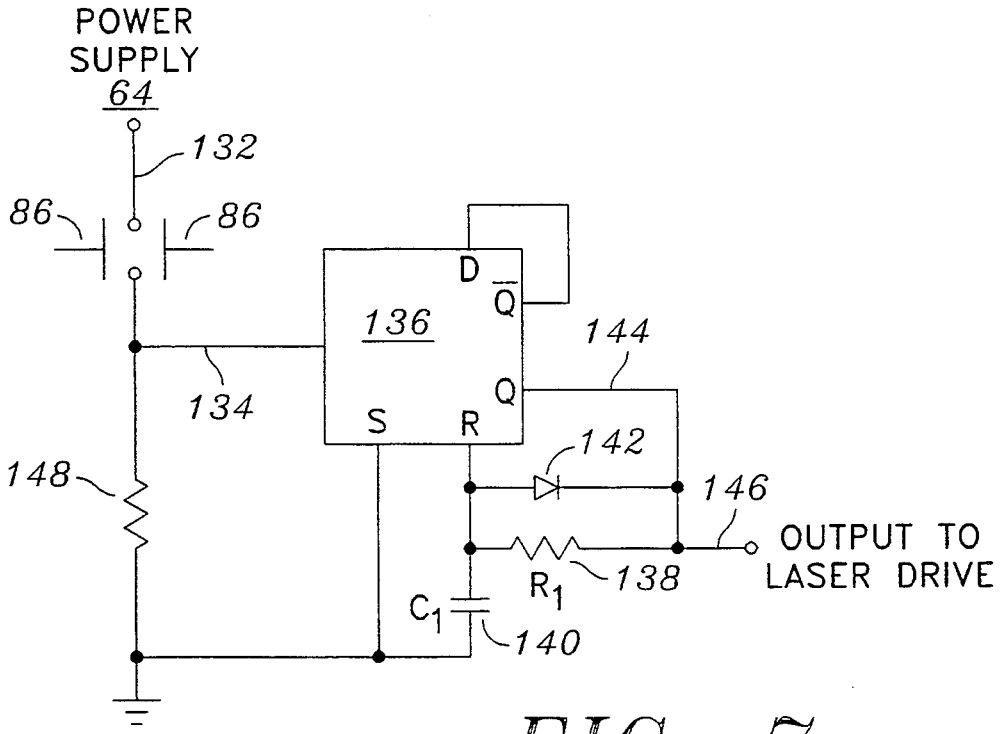
FIG. 7 is a schematic diagram of circuitry providing the power saving function to the laser driver circuit.

Referring to FIG. 7 there is schematically illustrated power saving circuitry which forms a part of the laser driver circuit. As illustrated the power saving circuitry includes, as the power supply, the battery 64, switches 86 which when closed complete the circuit through line 132 and 134 to a flip/flop 136 of conventional design. A resistor 138 (R1), capacitor 140 (C1) and diode 142 provide the reset time of the flip/flop 136. The Q output of the flip/flop 136 is led through a line 144 and a line 146 to activate the laser driver circuitry (not shown). A resistor 148 connected to ground maintains the bias of the circuit to ground while the switches 86 are open.

The resistor 138 has a high resistance value, typically on the order of 20 M ohms. The capacitor 140 also has a high capacitance valued, on the order of about 6 micro Farads. The laser driver circuit is activated by closing either of the switches 86 to momentarily complete the circuit from the battery 64 through a line 132 and a line 134 to latch the Q output of the flip/flop 136. This also initiates the system charging cycle R1/C1 and the flip/flop 136 is set to turn off when $\frac{2}{3}$ of the charging voltage of the capacitor 140 is reached. With the 20 M ohm resistance value for the resistor 138, the capacitor will reach $\frac{2}{3}$ of its charging capacity in about 2 minutes and the system will be turned off. This feature avoids draining the battery in the event the switch 86 is accidentally closed so that the laser does not drain the power supply unintentionally. Depressing one of the switches 86 while the system is charging interrupts the cycle and resets the flip/flop 136. The diode 142 serves to insure that the capacitor 140 is completely discharged when the system is shut off.

I claim:

1. An aiming system for an automatic hand weapon, said hand weapon having a receiver group including a trigger assembly and a trigger guard, said device comprising:

a housing adapted to be mounted on said receiver group, said housing defining a front laser emission end, an opposite mounting end, a lower surface, side walls, a rear face and a top face configured to receive at least a portion of said receiver group, said housing having two vertically aligned compartments each opening at said emission end of said housing and being closed at the opposite end to define a rear wall therefor, a chamber opening to the rear face of said housing, a laser emission module contained in one of said compartments, said laser emission module comprising a container in which are disposed a laser diode and associated laser driver circuitry, the container being optically transparent at its emission end and closed at the opposite end, a power supply disposed in said other compartment, passage means communicating between said chamber and each of said compartments, switching means in said chamber electrically connected to said laser module and said power supply for activating said laser diode;

means carried by said housing for contacting and moving said laser module to adjust the vertical and the horizontal alignment of said laser module;

mounting means comprising a mounting plate attached at each side face of said laser housing at the mounting end thereof, portions of said mounting plates extending rearwardly from said housing defining oppositely inwardly turned spaced apart stops at the extending edges thereof, a passage communicating between the lower surface and the rear face of said housing and a securing member axially movably disposed therein; and control means operable from either side wall of said housing for activating said aiming system.

2. The aiming system of claim 1 further including a bearing seat in the rear face of said housing opening to the surface thereof, said passage opening to said bearing seat and a bearing is outwardly, movably disposed in said bearing seat, whereby said securing member acts against said bearing to move it outwardly in said bearing seat responsive to the axial movement of said securing member.

3. The aiming system of claim 1 wherein a retainer seat is disposed in the rear wall of said compartment containing said laser module, the radius of the retainer seat being less than that of the compartment, its center point being readially, upwardly spaced from the axis of said compartment, a spring disposed in the retainer seat, the outside diameter of said laser module being less than the inside diameter of said compartment and being free to the moved radially therein, the opposite end of said laser module being carried by said spring and being radially upwardly and outwardly disposed with respect to the axis of the compartment, a first inwardly downwardly biased threaded passage opening to a side wall of said laser housing and extending therethrough to the compartment, an adjustment member having an end adapted for contact with said laser module to effect elevation adjustments in response to the axial displacement of said adjustment member, a second oppositely inwardly downwardly biased threaded passage opening to an opposite side wall of said laser housing and extending therethrough to the compartment, an second adjustment member having an end adapted for contact with said laser module to effect windage adjustments in response to the axial displacement of said adjustment member, said second passage being biased downwardly at a greater angle with respect to horizontal than said first passage.

4. The aiming system of claim 2 wherein said first passage is biased downwardly with respect to horizontal at an angle of between about 15° and about 20° and said second passage is biased downwardly with respect to the horizontal at an angle of between about 25° and about 30°.

5. An automatic hand weapon including a receiver group, a barrel and a slide reciprocally mounted on the receiver group for movement relative to said barrel and said receiver group, said receiver group including a trigger assembly, a trigger guard and a laser aiming system, said system comprising:

a housing defining a front laser emission end, an opposite mounting end, a lower surface, side walls, a rear face and a top face configured to receive at least a portion of said receiver group mounted under said receiver group with said rear face proximate said trigger guard, said housing having two vertically aligned compartments each opening at said emission end of said housing and being closed at the opposite end to define a rear wall, a chamber opening tot he rear face of said housing, a laser emission module contained in one of said compartments, said laser emission module comprising a container in which are disposed a laser diode and associated laser driver circuitry, the container being optically transparent at its emission end and closed at the opposite end, a power supply disposed in said other compartment, passage means communicating being said chamber and each of said compartments, switching means in said chamber electrically connected to said laser module and said power supply for activating said laser diode;

means carried by said housing for contacting and moving said laser module to adjust the vertical and the horizontal alignment of said laser module;

mounting means comprising a mounting plate attached at each side face of said laser housing at the mounting end thereof, said mounting plates extending rearwardly from said housing on either side of said the trigger guard, the extending ends of said mounting plates being oppositely inwardly turned and configured to the shape of the trigger guard forward of the trigger to define spaced apart stops, a threaded passage communicating between the lower surface and the rear face of said housing and a securing member disposed in said threaded passage, said securing member acting against said trigger guard to create a pivoting force on said housing to secure the top surface thereof against said receiver group responsive to the axial movement of said securing member; and control means operable from either side of said housing for activating said aiming system.

6. The aiming system of claim 5 further including a bearing seat in the rear face of said housing opening to the surface thereof, said threaded passage opening to said being seat and said securing member comprises a bearing outwardly, movably disposed in said bearing seat and a screw in said threaded passage, whereby axial movement of said securing screw urges said bearing outwardly in said bearing seat against said trigger guard.

* * * * *